US008487822B1

(12) United States Patent
Jennings

(10) Patent No.: US 8,487,822 B1
(45) Date of Patent: Jul. 16, 2013

(54) ADAPTIBLE ANTENNA USING LIQUID METAL STRUCTURES

(75) Inventor: William C. Jennings, Iowa City, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1020 days.

(21) Appl. No.: 11/900,843

(22) Filed: Sep. 13, 2007

(51) Int. Cl.
*H01Q 3/22* (2006.01)

(52) U.S. Cl.
USPC ..... 343/745

(58) Field of Classification Search
USPC ... 343/745, 700 MS, 749, 752, 750; 700/281; 136/203; 62/3.2
See application file for complete search history.

(56) References Cited

U.S. PATENT DOCUMENTS

| | | | | |
|---|---|---|---|---|
| 2,142,117 | A * | 1/1939 | Dow | 343/700 R |
| 2,278,601 | A * | 4/1942 | Werndl | 343/723 |
| 3,447,376 | A * | 6/1969 | Turtora et al. | 374/168 |
| 4,077,749 | A * | 3/1978 | Hogg | 417/321 |
| 5,792,236 | A * | 8/1998 | Taylor et al. | 75/715 |
| 6,020,854 | A | 2/2000 | Jagnow et al. | 343/705 |
| 6,883,227 | B2 * | 4/2005 | Lebaric et al. | 29/600 |
| 2003/0033819 | A1 * | 2/2003 | Prescott | 62/3.7 |
| 2004/0055857 | A1 * | 3/2004 | Narasimhan | 200/61.47 |
| 2004/0252069 | A1 * | 12/2004 | Rawnick et al. | 343/789 |
| 2005/0238538 | A1 * | 10/2005 | Braig et al. | 422/82.05 |

* cited by examiner

*Primary Examiner* — Robert Karacsony
(74) *Attorney, Agent, or Firm* — Donna P. Suchy; Daniel M. Barbieri

(57) ABSTRACT

A variable frequency antenna including a dielectric element and an enclosure within the dielectric element. An electrically conductive liquid metal is disposed in the enclosure. The liquid metal is a eutectic mix of about 68.5% gallium, about 21.5% indium, and about 10% tin. Changing the temperature of the liquid metal causes the liquid metal to change volume within the enclosure, thereby changing an RF frequency characteristic of the liquid metal.

6 Claims, 4 Drawing Sheets

ADAPTIBLE ANTENNA USING LIQUID METAL STRUCTURES

FIELD OF THE INVENTION

The present invention relates generally to the field of communications, and more particularly to antennas.

BACKGROUND OF THE INVENTION

In antenna technology it is important to provide suitable means to modify the electrical characteristics or performance of an antenna to adapt the antennas performance to the operating environment. Typical modifiable antenna characteristics include but are not limited to antenna aperture, operating frequency and bandwidth, directionality and gain, radiation pattern and impedance matching, voltage standing wave ratio (VSWR), as well as antenna power handling capability. Some methods to modify antenna performance have included changing the geometry of the radiating element, adding capacitive hats, selectively connecting multiple antennas or antenna elements, using different materials, and the like. One way to modify antenna characteristics is to employ a liquid metal such as mercury in an enclosed chamber. When heated or cooled, the mercury expands or contracts within the chamber. Because of its low interfacial resistance and high conductivity, the mercury can act as an antenna radiating element that can have its frequency range varied by varying its temperature. However, mercury is a well-known biological hazard, making it unsuitable for commercial use.

It is therefore an object of the invention to provide a variable frequency antenna.

Another object of the invention is to provide a variable frequency antenna using a non-hazardous liquid metal.

A feature of the invention is the use of a gallium-based alloy in liquid form at ambient temperatures as a variable-length radiating element in an antenna.

An advantage of the invention is that the gallium-based alloy is environmentally and biologically safe to handle and use.

Another advantage is that a single liquid-metal antenna can be modified for use over a variety of frequencies by heating and cooling the liquid metal.

SUMMARY OF THE INVENTION

The invention provides a variable frequency antenna. The invention includes a dielectric element and an enclosure within the dielectric element. An electrically conductive liquid metal is disposed in the enclosure. The liquid metal is a eutectic mix of about 68.5% gallium, about 21.5% indium, and about 10% tin. Changing the temperature of the liquid metal causes the liquid metal to change volume within the enclosure, thereby changing an RF frequency characteristic of the liquid metal.

The invention also provides a variable frequency antenna including a dielectric element and an enclosure within the dielectric element. An electrically conductive liquid metal is disposed in the enclosure. A Peltier module is configured to transfer heat to and from the liquid metal, thereby changing a temperature of the liquid metal. A conducting interface has a surface area disposed to contact the liquid metal. The conducting interface is thermally connected to the thermal module and transfers heat between the conducting interface and the thermal module. The conducting interface has a thermal conductivity similar to a thermal conductivity of the liquid metal. Changing the temperature of the liquid metal causes the liquid metal to change volume within the enclosure, thereby changing an RF frequency characteristic of the liquid metal.

The invention further provides a variable frequency antenna, including a dielectric element and an enclosure within the dielectric element. An electrically conductive liquid metal disposed in the enclosure. The liquid metal is a eutectic mix of about 68.5% gallium, about 21.5% indium, and about 10% tin. A thermal module is configured to transfer heat to and from the liquid metal, thereby changing a temperature of the liquid metal. A conducting interface has a surface area disposed to directly contact the liquid metal. The conducting interface is thermally connected to the thermal module and is configured to transfer heat between the conducting interface and the thermal module. The conducting interface has a thermal conductivity similar to a thermal conductivity of the liquid metal. The enclosure includes a cavity shaped such that the liquid metal forms a monopole radiating element when contained therein. The enclosure also includes a chamber shaped such that the liquid metal forms a capacitive hat when contained therein. Changing the temperature of the liquid metal causes the liquid metal to change volume within the enclosure, thereby changing an RF frequency characteristic of the liquid metal.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE DRAWINGS

Reference will now be made in detail to the presently preferred embodiments of the invention, examples of which are illustrated in the accompanying drawings. It is to be appreciated that corresponding reference numbers refer to generally corresponding structures.

Figure 1:
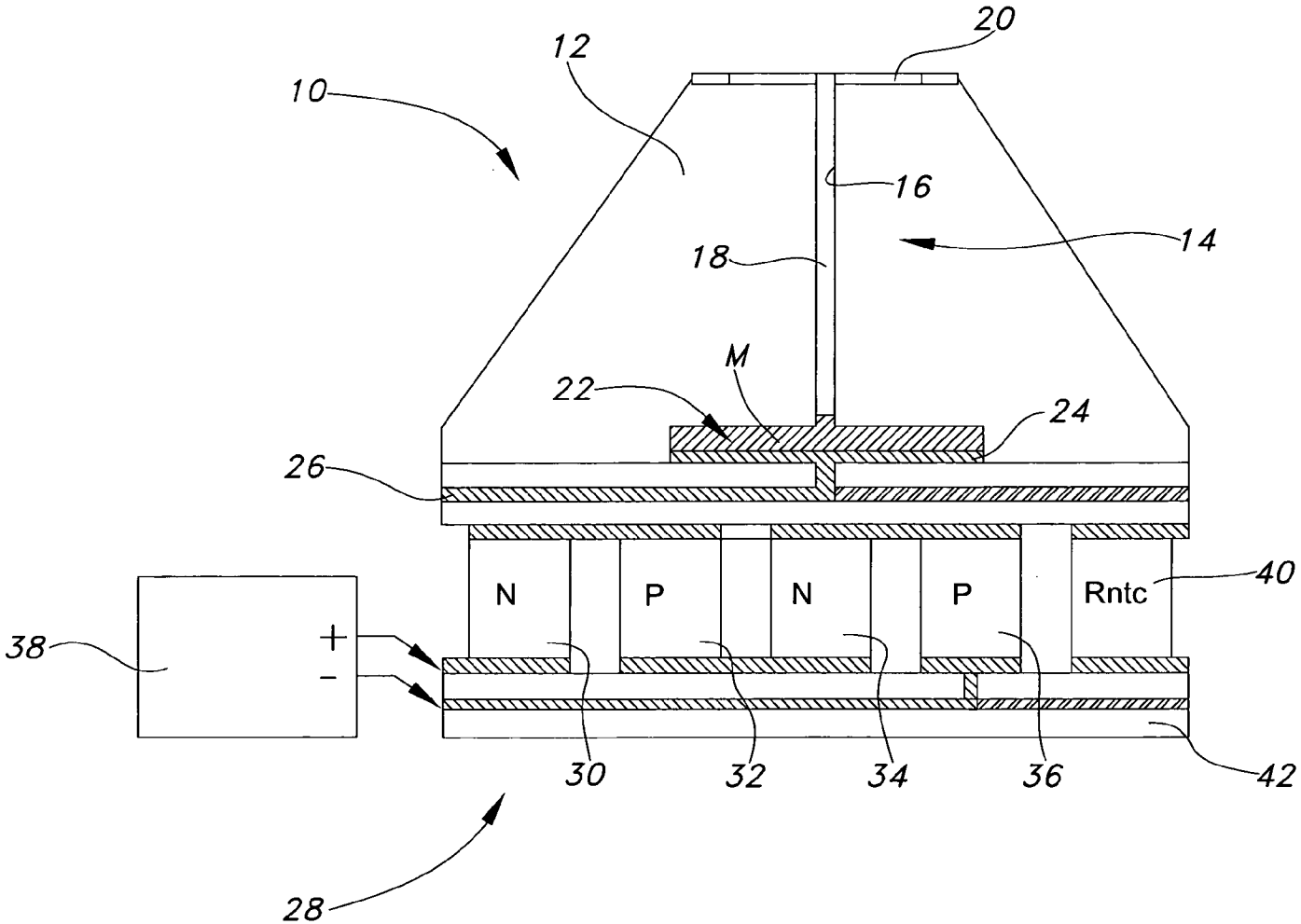
FIG. 1 is a schematic diagram of a cross-sectional view of an antenna according to the invention.

FIG. 1 is a schematic view of a liquid metal antenna 10 according to the invention. Antenna 10 includes a dielectric 12 shaped to conform to the design requirements of the device in which the antenna is used. In the displayed embodiment the dielectric is shaped to be used in an antenna fuse (not shown). An envelope 14 is formed in dielectric 12 through molding, milling, machining or the like. Envelope 14 is designed to be sealed and capable of maintaining a vacuum pressure after having all air evacuated therefrom. The shape of envelope 14, as described herein, provides shape and form to the radiating element of the antenna. A liquid metal M is placed into envelope to form the variable-size radiating element of the antenna according to the invention. The liquid metal preferred for use as an antenna radiating element in this disclosure is known as galinstan, which is a non-toxic and an environmentally benign metal with a very low melting point. Specifically, galinstan is composed of a eutectic mix of 68.5% gallium, 21.5% indium and 10% tin. Galinstan has a melting point of −19° C. and a coefficient of thermal expansion of 180 ppm/° C. Its thermal conductivity is 54 W/m-K.

After the galinstan is placed into envelope 14 and all air is displaced therein, the envelope is sealed. The envelope is shaped to accommodate the expansion and contraction of galinstan and to accommodate the physical antenna shape. More specifically, the containment of the galinstan liquid metal by envelope 14 defines the shape the liquid metal antenna radiator takes and ultimately the electrical radiating performance of the antenna. Since galinstan readily wets glass or plastic, a thin gallium oxide coating 16 is applied to the envelope interior to prevent wetting of the envelope walls. Envelope 14 includes an expansion cavity 18 that accommodates changes in the liquid volume and changes of state from liquid to solid. Expansion cavity 18 is connected at one end to an expansion chamber 20 which, when partially or completely filled by galinstan liquid metal, creates a radiating element of the antenna. Expansion chamber may comprise a cylindrical space sufficient to create a top-hat type capacitive radiating element, or if finer frequency resolution is desired, a thin tunnel may be used instead, which when filled with galinstan approximates a conductive wire. Envelope 14 also includes a reservoir 22 designed to contain a sufficient amount of surplus or reserve galinstan to accommodate expansion over the operating temperature range of the antenna. The quantity of galinstan contained in reservoir 22 is determined by calculating the volume needed to effect a physical change in the size or shape of the antenna radiating or tuning elements as defined by expansion chamber 20.

Reservoir 22 has a direct thermal conduction path to a controlled heat sink/source. This thermal conduction path must offer a low interfacial resistance and a thermal conductivity similar to the thermal conductivity of galinstan which is as high as 54 W/m-K. Preferably, the galinstan reservoir has a conducting interface 24, which as depicted in FIG. 1 is a copper element having a large surface area contact with the galinstan in the reservoir. It is desirable for the galinstan in the reservoir to wet the surface of the copper conducting interface, and therefore no gallium oxide coating is used at this interface. Conducting interface 24 forms part of a thermal conduction path to the controlled heat sink/source, as will be explained further herein. Conducting interface 24 also serves as the RF connection to the antenna through a radio-frequency (RF) microstrip transmission line 26, and appropriate design of the conducting interface results in an appropriate impedance match from the RF microstrip transmission line to the galinstan-formed antenna element.

A thermal heating and cooling device is coupled to reservoir 22 for facilitating heat transfer to or from the liquid metal to effect thermal expansion or contraction. The preferred thermal heating and cooling device is a low mass Peltier module 28, which is typically referred to commercially as a thermoelectric cooler (TEC). Peltier module 28 consists of semiconductors 30, 32, 34, 36 mounted successively to form p-n- and n-p-junctions. Each junction has a thermal contact with the galinstan reservoir. The passage of electrical current of definite polarity from a thermal controller 38 through each semiconductor junction heats or cools the junction depending upon the direction of the current. In the preferred embodiment a the thermal controller is a digital feedback temperature controller that precisely regulates the thermal heating and cooling of Peltier module 28 to effect precise expansion or contraction of the galinstan liquid metal. Many integrated circuit single chip precision thermal controllers are commercially available. Known thermal controllers typically use an H-bridge (not shown) to provide reversible power to the Peltier module from a single supply. Forced pulse-width-modulation (PWM) control, used in known thermal controllers, allows current to be sourced or sinked. Typical temperature regulation to within ±0.1° C., without hunting, during transition from heating to cooling modes, is common.

A precision resistance-temperature surface mounted device (SMD) thermistor 40 is integrated into the Peltier module to precisely sense the temperature of the galinstan liquid metal and provide temperature feedback to the thermal controller. Precision heating and cooling of the galinstan liquid metal is thus achieved. The precision resistance-temperature SMD is preferably a negative temperature coefficient (NTC) device to provide a high degree of temperature measurement accuracy. A heat sink or a heat spreader 42, comprising a large flat surface which may include cooling fins, is mounted adjacent to the Peltier module and is used to dissipate the heat that is generated by the TEC device so as to minimize the possible adverse effects of overheating, dimensional variations, variable operating characteristics and differential thermal expansion. Additionally, heat sink or spreader 42 may be of a passive type, or a fan could be attached for higher power handling requirements.

Figure 2:
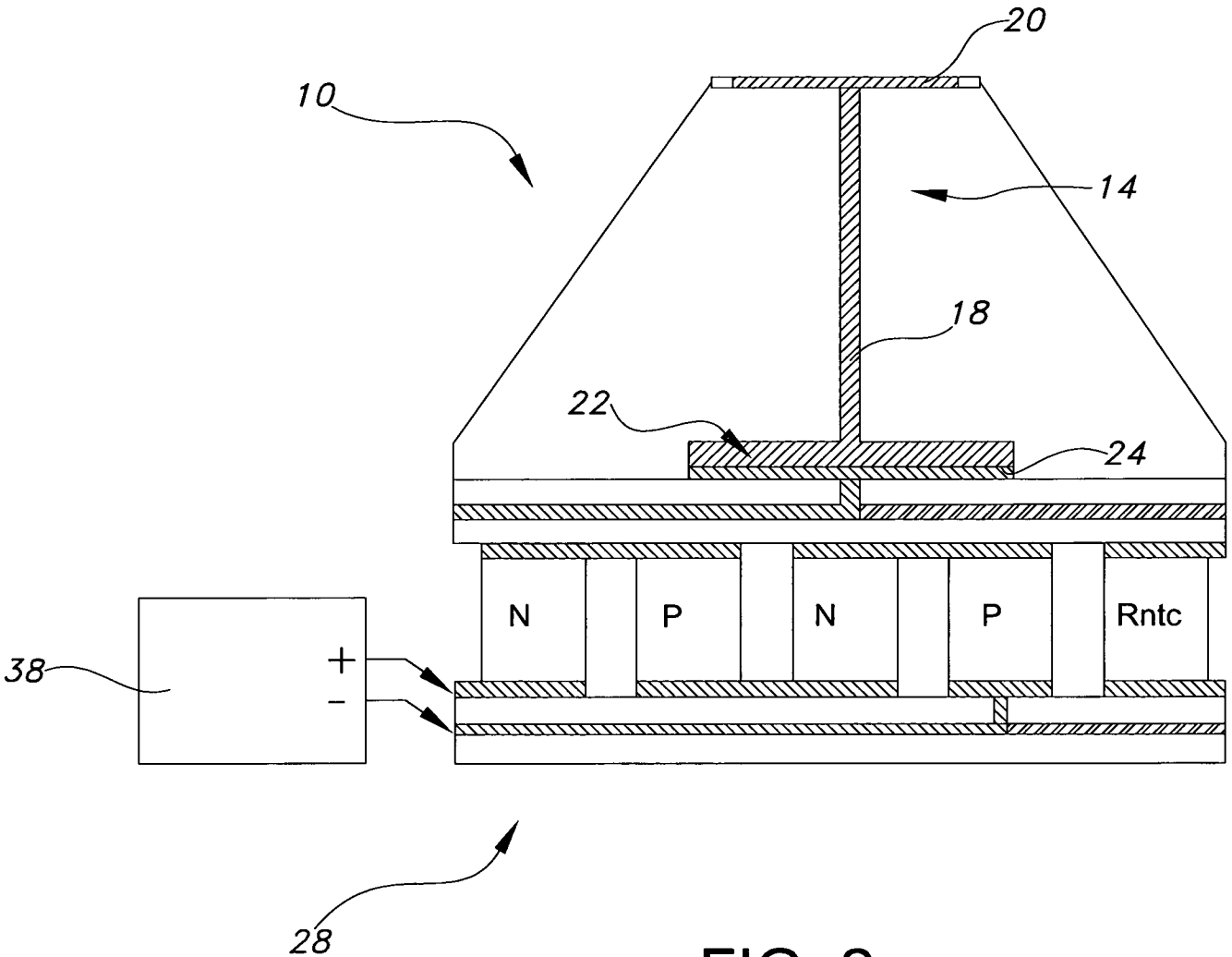
FIG. 2 is another cross-sectional view of the antenna of FIG. 1.

To operate the invention, thermal controller 38 sends an electrical current to the semiconductor junctions in Peltier module 28. Depending on the polarity of the current, the semiconductor junctions in the Peltier module create a heating or a cooling effect. Taking for example a heating effect, the heat created by the Peltier module is transferred to conducting interface 24. Galinstan in reservoir 22 is heated because of a temperature difference between the galinstan and the conducting interface. The heated galinstan increases in volume, thereby filling expansion cavity 18 and expansion chamber 20, as shown in FIG. 2. The galinstan is thereby shaped as an antenna radiating element, and RF signals can be received and transmitted as desired. To reverse the effect, thermal controller 38 sends an electrical current, having a polarity reverse from the signal previously sent, to the semiconductor junctions in Peltier module 28. A cooling effect is created, which is transferred to conducting interface 24. Because of the temperature difference between the conducting interface and the galinstan in reservoir 22, the galinstan in envelope 14 is cooled and is reduced in volume until, ultimately, the galinstan fills only reservoir 22 as shown in FIG. 1. The antenna so formed by the heating and cooling of the galinstan creates a top-hat loaded monopole that permits tuning between the L-band C/A-code and P/Y-code frequencies (1575 MHz and 1227 MHz, respectively) by decreasing and increasing, respectively, the diameter of the top-hat. Such an antenna can therefore be used in a GPS enabled NATO standard fuse, as shown in U.S. Pat. No. 6,020,854, the disclosure of which is incorporated by reference herein in its entirety.

FIGS. 1 and 2 depict the two extremes of a complete filling of envelope 14 by the heated galinstan on the one hand, and a complete evacuation of expansion cavity 18 and expansion chamber 20 on the other hand. Of course, the temperature of the galinstan may be modulated, using SMD thermistor 40 and thermal controller 38, to accomplish any desired volume of galinstan within the envelope, depending on the desired frequency characteristics of the antenna. Because galinstan temperature and volume are linearly related, the relationship between temperature and antenna frequency can also be predicted or otherwise easily determined. Then, when a particular antenna frequency is desired, thermal controller 38 directs Peltier module 28 to achieve a specific frequency.

Figure 3:
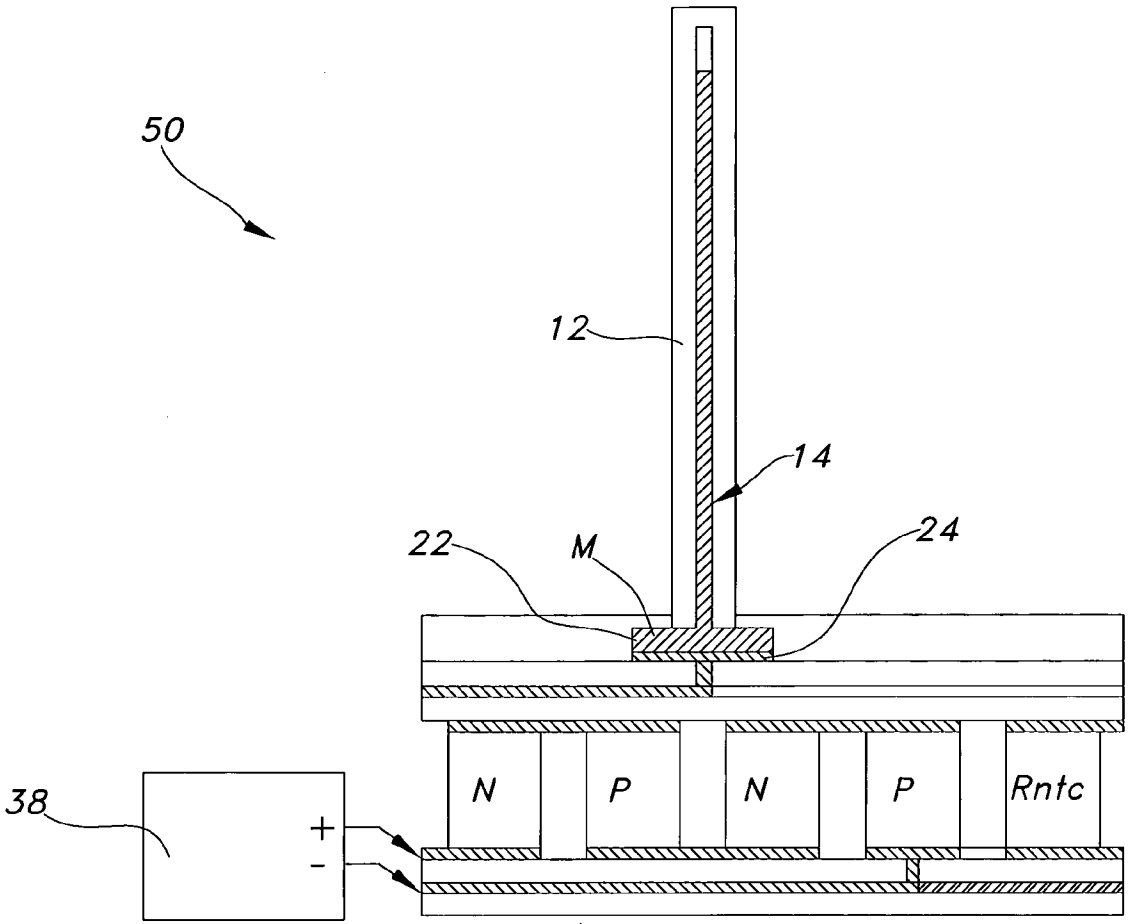
FIG. 3 is a schematic diagram of a cross-sectional view of an antenna according to another embodiment of the invention.

The invention is not limited to the structure disclosed in the embodiment shown in FIGS. 1 and 2. FIG. 3 depicts a vertical monopole liquid metal antenna 50 according to another embodiment of the invention. Dielectric 12 has a shape approximating the shape of expansion cavity, and no top-hat type radiating element is included. Thermal controller 38 sends electrical signals to Peltier Module 28, which heats and cools conducting interface 24 and the conductive liquid metal M within reservoir 22. The expanding and contracting liquid metal within the envelope 14 varies the operating frequency of antenna 50.

Figure 4:
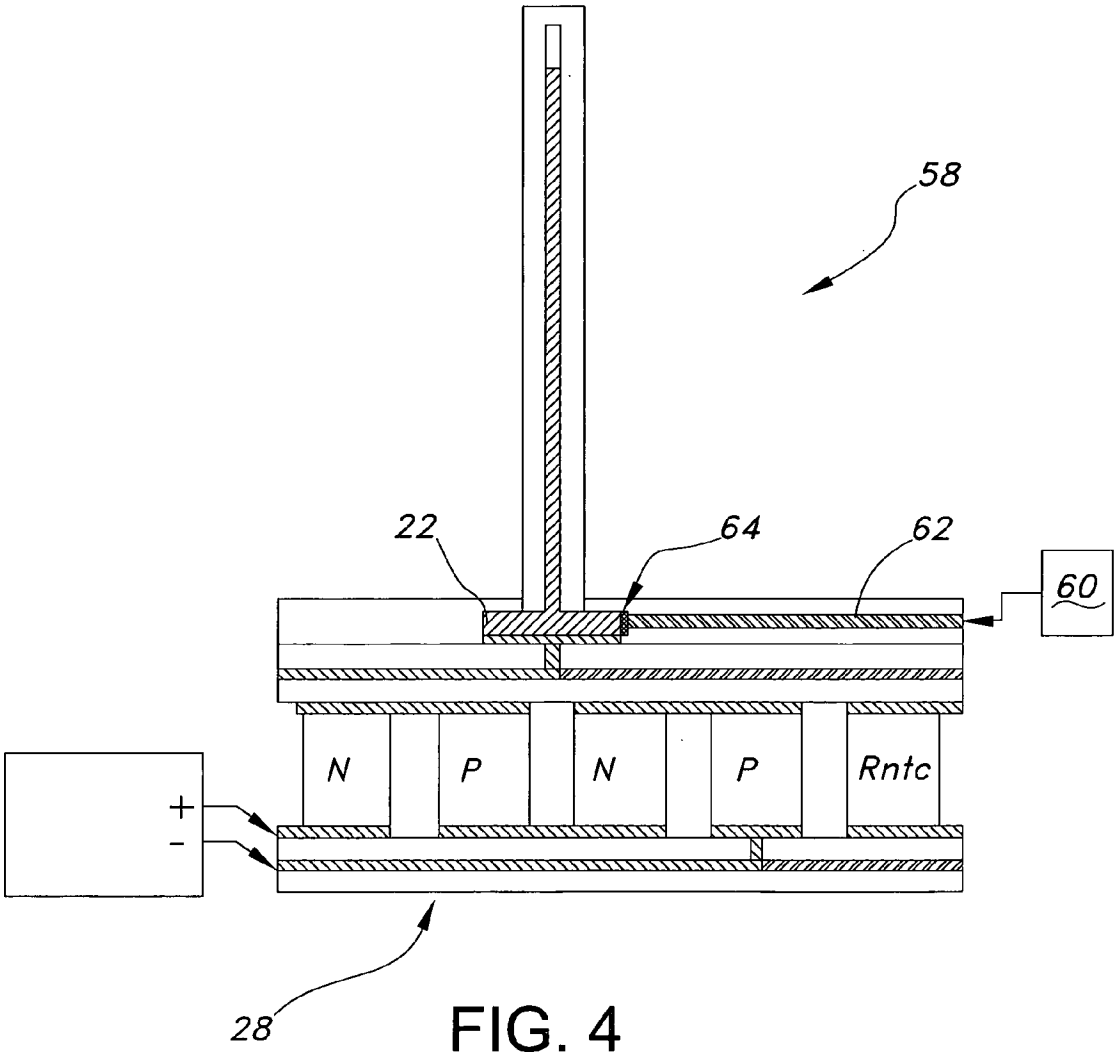
FIG. 4 is a schematic diagram of a cross-sectional view of an antenna according to still another embodiment of the invention.

The invention has been described herein as using a Peltier module to heat and cool the liquid metal within a sealed envelope. However, other heating and cooling means may be used. For example, FIG. 4 depicts a hybrid thermal heating and cooling configuration for a monopole antenna 58 where Peltier module 28 is relied upon to cool and reduce the volume of the galinstan as previously described. The galinstan is heated by an optical source such as an infrared diode 60 that emits wavelengths of light at approximately 808 nm, for example. An optical waveguide network 62 directs the emitted light to an optical absorbing interface 64 that contacts reservoir 22. Optical absorbing interface 64 is made of a material that absorbs the light wavelengths emitted by infrared diode 60, thereby converting the emitted light into thermal energy that is transfei'red to the galinstan in reservoir 22. In this manner the galinstan in the reservoir is heated and caused to expand. The optical source and the Peltier module are controlled to selectively heat and cool the galinstan, respectively. As depicted in FIG. 4, Peltier module 28 may still have a heating function and may be used, for example, to maintain the galinstan at an ambient temperature. Other means of heating and cooling the galinstan are within the scope of the invention.

The invention as described herein provides a means of varying antenna characteristics of an antenna by heating and cooling an amount of liquid metal in an enclosure. An advantage of the invention is the use of environmentally and biologically safe galinstan eliminates the hazards of mercury-based liquid metal antennas.

Another advantage is that with precise heating and cooling of the liquid metal, the antenna frequency may be precisely varied as well.

Still another advantage is that in applications where space is at a premium, such as inside an artillery shell, a single antenna can be used for communication and navigation as desired.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A variable frequency antenna, comprising:

a dielectric element;

an enclosure within the dielectric element; and an electrically conductive liquid metal disposed in the enclosure;

a thermal module configured to transfer heat to and from the liquid metal;

a conducting interface having a surface area disposed to contact the liquid metal, the conducting interface serving as a radio frequency (RF) connection to the antenna via a radio frequency (RF) microstrip transmission line, and wherein the conducting interface has a thermal conductivity similar to a thermal conductivity of the liquid metal;

wherein changing a temperature of the liquid metal causes the liquid metal to change volume within the enclosure, thereby changing a radio frequency (RF) characteristic of the liquid metal.

2. The variable frequency antenna of claim 1, wherein the thermal module includes a Peltier module.

3. The variable frequency antenna of claim 1, wherein the thermal module includes an optical heating apparatus to provide heat to the liquid metal, the optical heating apparatus including an infrared diode, an optical waveguide network, and an optical absorbing interface, the infrared diode being configured for emitting light, the optical waveguide network being connected to the infrared diode and being configured for directing the emitted light to the optical absorbing interface, the optical absorbing interface being configured for absorbing the emitted light, converting the emitted light into heat, and transferring said heat to the liquid metal.

4. The variable frequency antenna of claim 1, further comprising a heat sink configured to dissipate heat removed from the liquid metal by the thermal module.

5. The variable frequency antenna of claim 1, further comprising an anti-wetting compound applied to a surface of the enclosure to prevent the liquid metal from wetting the surface of the enclosure.

6. The variable frequency antenna of claim 5, wherein the anti-wetting compound is gallium oxide.

* * * * *